US005942720A

United States Patent [19]

Doll et al.

[11] Patent Number: 5,942,720

[45] Date of Patent: Aug. 24, 1999

[54] PROCESSING AND CURING AID FOR COMPOSITE PROPELLANTS

[75] Inventors: Daniel W. Doll, North Ogden; Gary K. Lund, Ogden, both of Utah

[73] Assignee: Cordant Technologies Inc., Salt Lake City, Utah

[21] Appl. No.: 08/055,079

[22] Filed: Apr. 29, 1993

[51] Int. Cl.[6] ..... C06B 21/00; C06B 45/10

[52] U.S. Cl. ..... 149/19.92; 149/19.4; 264/3.1

[58] Field of Search ..... 149/19.4, 19.6, 149/19.92; 264/3.1

[56] References Cited

U.S. PATENT DOCUMENTS

| | | | |
|---|---|---|---|
| 3,245,849 | 4/1966 | Klager et al. | 149/19.4 |
| 3,625,782 | 12/1971 | Oberth et al. | 149/19.4 |
| 3,811,967 | 5/1974 | Strickler et al. | 149/19.4 |
| 3,919,011 | 11/1975 | Oberth et al. | 149/19.4 |
| 4,038,114 | 7/1977 | Oberth | 149/19.4 |
| 4,110,135 | 8/1978 | Graham et al. | 149/19.4 |
| 4,184,031 | 1/1980 | Graham et al. | 528/55 |
| 4,263,444 | 4/1981 | Graham et al. | 149/19.4 |
| 4,379,903 | 4/1983 | Reed, Jr. et al. | 528/55 |
| 4,601,344 | 7/1986 | Reed et al. | 149/19.6 |
| 4,650,617 | 3/1987 | Kristofferson et al. | 149/19.4 |
| 4,803,019 | 2/1989 | Graham et al. | 149/19.4 |
| 4,913,753 | 4/1990 | Ducote | 149/19.9 |
| 4,925,909 | 5/1990 | Kubota et al. | 149/19.6 |
| 4,938,813 | 7/1990 | Eisele et al. | 149/19.2 |
| 5,171,818 | 12/1992 | Wilson | 528/59 |
| 5,348,596 | 9/1994 | Goleniewski et al. | 149/19.6 |

*Primary Examiner*—Edward A. Miller
*Attorney, Agent, or Firm*—Pillsbury Madison & Sutro, LLP

[57] ABSTRACT

The processing and cure of high solids (>85%) composite propellants at ambient temperature and pressure is accomplished by using a small amount (≦0.1 weight percent) of a liquid dialkyl tin catalyst, such as dibutyltindiacetate and dibutyltindilaurate. The propellant binder system is composed of a branched, oxygen-containing polymer, such as polyethers, polypropylene oxide, polybutylene oxide, high homologues or mixtures thereof, and a sterically hindered diisocyanate curing agent. The liquid dialkyl tin catalyst unexpectedly serves as a wetting agent to lower the viscosity of the composite propellant formulation.

14 Claims, No Drawings

PROCESSING AND CURING AID FOR COMPOSITE PROPELLANTS

BACKGROUND OF THE INVENTION

1. Field of the Invention

This invention relates to the processing and curing of composite propellants. More specifically, the present invention relates to the use of small amounts of liquid dialkyl tin catalysts with polyurethane binders to lower viscosity and improve processing and curing properties for high-solids composite propellants.

2. Technology Review

A common problem with composite propellant compositions is a lack of oxidizer for efficient combustion. One proposed solution is to use oxygenated polymeric binders, such as polyethers, polypropylene oxide, and polybutylene oxide in a high-solids system, to supplement conventional oxidizers in the propellant formulation. Regrettably, such polymers do not cure well using conventional curing agents and catalysts such as IPDI (isophorone diisocyanate) and TPB (triphenyl bismuth).

Polyurethane binders composed of polypropylene oxide and isocyanate curatives have been used as binders in composite propellants. In practice, the solid component incorporated into such polymer systems never exceeds about 85%. Composite propellant compositions having high solids content are desirable because they have better performance characteristics, such as specific impulse (pounds of force generated per pound of propellant). Unfortunately, above 85% solids content, the viscosity becomes too high to process.

It was found that raising the mixing and curing temperature above about 135° F. (60° C.), lowers the viscosity enough to enable processing of the composite propellant. However, high temperature mixing and curing requires expensive facilities and equipment and induces stresses and strains in the propellant grain upon cooling to ambient temperatures. In addition, for systems utilizing ammonium nitrate as an oxidizer, ammonium nitrate undergoes a phase change at temperatures above about 90° F. (32° C.) in which the ammonium nitrate crystals tend to grow and swell. This is extremely undesirable because it can destroy the shape and performance properties of processed composite fuel grains. Additives, such as metal oxides and nitrates, are known to stabilize the ammonium nitrate phase change, but they are expensive and unreliable. Moreover, since such additives are inert, they decrease the propellant's performance characteristics.

It will be appreciated that there is a need in the art for methods and compositions for processing and curing composite propellants having high solids content at ambient temperatures.

Such methods and compositions for processing and curing high-solids composite propellants are disclosed and claimed herein.

SUMMARY OF THE INVENTION

The present invention enables high-solids composite propellants to be processed and cured at ambient temperature. Adding small amounts of a liquid dialkyl tin catalyst to propellant binder systems composed of a branched, sterically hindered oxygen-containing polymer and a sterically hindered diisocyanate curing agent lowers viscosity sufficiently to enable processing and curing of high-solids composite propellants at ambient temperature.

DETAILED DESCRIPTION OF THE INVENTION

The processing and cure of high solids (>85%) composite propellants at ambient temperature (70° F.±20° F.) and pressure is accomplished by using a liquid dialkyl tin cure catalyst, such as dibutyltindiacetate and dibutyltindilaurate. Other analogous tin cure catalysts having sizes between diacetate ($C_2$) and dilaurate ($C_{12}$) such as dibutyltindipropionate, dibutyltindibutyrate, dibutyltindivalerate, dibutyltindicaproate, dibutyltindienanthate, dibutyltindicaprylate, dibutyltindipelargonate, dibutyltindicaprate, etc. may also be used.

The propellant binder system contains a branched, sterically hindered oxygen-containing polymer, such as a polyether, polypropylene oxide, polybutylene oxide, high homologues or mixtures thereof, and a sterically hindered diisocyanate curing agent such as isophorone diisocyanate (IPDI) and tetramethylxylenediisocyanate (TMXDI). Mixtures of polymers, such as ethylene oxide/propylene oxide co-polymers, may also be used in the present invention provided the polymer chain is terminated with a 2° hydroxyl group and the copolymer does not contain an ethylene oxide greater than 15%. The sterically hindered oxygen containing polymer typically has a molecular weight in the range from about 1000 to about 10,000, and preferably has a molecular weight from about 1000 to about 2000.

The degree of steric hinderance in the polymer and diisocyante curing agent affects the pot life of the resulting propellant binder. If there is too much steric hinderance, then the cure time may be too slow or a full cure may never be achieved. If there is insufficient steric hinderance, than the cure reaction may be too quick to provide a reasonable pot life.

A small amount of plasticizer, such as mineral oil, dioctyladipate (DOA), isodecylperlargonate (IDP), dioctylphthalate (DOP), dioctylmaleate (DOM), dibutylphthalate (DBP), oleyl nitrile, or mixtures thereof may also be added to improve propellant processing.

The liquid dialkyl tin catalyst, when added to the sterically hindered oxygen-containing polymer and diisocyanate curing agent, unexpectedly serves as a wetting agent to lower the viscosity of the composite propellant formulation regardless of oxidizer type (ammonium perchlorate or ammonium nitrate) and fuel type (Al or Mg). In addition, high solids (>85%) can be processed and cured at ambient temperature thereby eliminating the need for high temperature mixing and curing processes. These propellants exhibit desirable ballistic and energetic properties relative to hydroxy terminated polybutadiene (HTPB) analogues in addition to offering potential cost and manufacturing improvements.

In addition to the propellant binder system, the composite propellant compositions generally include one or more oxidizers and reactive metals dispersed throughout the binder. Typical oxidizers include commonly used oxidizers for propellant compositions, such as ammonium nitrate (AN), ammonium perchlorate (AP), hydroxylammonium nitrate (HAN), alkali metal perchlorates, alkali metal nitrates, or mixtures thereof. Typical reactive metal fuels include those commonly used in propellant compositions such as Al, Mg, Zn, B, W, Zr, Ti, or mixtures thereof.

Advantageously, the present invention enables processing to be performed at temperatures in the range from about 50° F. to about 150° F., including ambient temperatures (80° F. to 100° F.) below the phase transition temperature of ammonium nitrate. Thus, high solids loading of low-cost ammonium nitrate is possible using the teachings of the present invention.

The pot life, i.e., the handling time available between mixing and when the composition begins to set up, and cure time of the binder system is dependent on the specific materials used, the mixing and curing temperature, the size of the cured grain, and the catalyst concentration. A pot life of 3–7 hours is typically desired to allow casting of the propellant into rocket motor cases. Curing time is dependent upon many factors, but is typically carried out within the range of 1 to 10 days, preferably 2 to 5 days, with a short cure time being desired for reasons of economy. The curing temperature of the system can vary depending on factors such as desired cure time, but is preferably held within the range from about 20° C. to about 30° C., but useful curing temperatures can range from 10° C. to 60° C.

The following examples are offered to further illustrate the present invention. These examples are intended to be purely exemplary and should not be viewed as a limitation on any claimed embodiment.

EXAMPLE 1

A propellant composition numbered 45880 was prepared by combining the following ingredients.

Propellant Mix 45880

| Ingredient | Wt. % |
|---|---|
| Polypropylene oxide (PPO) | 11.00 |
| Mineral Oil (MO) | 2.00 |
| Isocyanate (ISO) | 1.00 |
| Ammonium perchlorate (AP) | 29.00 |
| Ammonium nitrate (AN) | 38.00 |
| Al | 19.00 |
| DBTDA | 0.01 |
| Wt. % solids | 86 |
| Viscosity before DBTDA | 42 kP |
| Viscosity after DBTDA addition | 14 kP |
| Mix Bowl Temperature | ambient |

The PPO polymer, MO plasticizer, and Al were premixed for 5 minutes at ambient temperature. The solid oxidizers, AP and AN were batch added in several increments to achieve efficient wetting of the solid particles. This was accomplished by first adding about ½ of the AN to the mixture and mixing for 5 minutes. Approximately ⅓ of the AP was then added and mixed for 5 minutes. Another ⅓ of the AP was added and mixed for 5 minutes. The remaining AN was added to the mixture and mixed for 5 minutes, and the remaining ⅓ AP was added and mixed for 10 minutes. Then the ISO cure agent was added and mixed for 10 minutes. The viscosity of this propellant mixture was measured to be 42 kP at ambient conditions. Finally, the DBTDA (dibutyltindiacetate) cure catalyst was added to the mixture and mixed for 5 minutes, the viscosity of the propellant mixture dramatically dropped to 14 kP. The propellant formulation was cast according to conventional techniques.

EXAMPLE 2

A propellant composition numbered 16362 was prepared by combining the following ingredients.

Propellant Mix 16362

| Ingredient | Wt. % |
|---|---|
| Polypropylene oxide (PPO) | 11.94 |
| Isocyanate (ISO) | 1.05 |
| DOA | 2.00 |
| Mg | 22.00 |
| Ammonium nitrate (AN) | 63.00 |
| DBTDA | 0.01 |
| Wt. % solids | 85 |
| Viscosity before DBTDA | 27.2 kP |
| Viscosity after DBTDA addition | 20.8 kP |
| Mix Bowl Temperature | 90° F. |

The PPO polymer, DOA (dioctyladipate) plasticizer, and Mg were premixed for 10 minutes at ambient temperature. The solid oxidizer, AN, was batch added in ¼ increments with 10 minute mixing after each incremental addition to achieve efficient wetting of the solid particles. Then the ISO cure agent was added and mixed for 15 minutes. The viscosity of the propellant mixture was measured to be 27.2 kP at ambient conditions. The DBTDA (dibutyltindiacetate) cure catalyst was then added and mixed for 5 minutes, the viscosity of the propellant mixture dropped to 20.8 kP. The propellant composition was cast according to conventional techniques and cured. Shore A hardness measurements of propellant mix 16362 indicate that the propellant cure was complete after 7 days at a temperature of 77° F.±5° F. The cure time is typical of conventionally cured propellants at higher temperatures (≧135° F.).

EXAMPLE 3

A propellant composition numbered 45833 was prepared by combining the following ingredients.

Propellant Mix 45833

| Ingredient | Wt. % |
|---|---|
| Polypropylene oxide (PPO) | 10.54 |
| Mineral Oil (MO) | 2.00 |
| Isocyanate (ISO) | 1.45 |
| Ammonium perchlorate (AP) | 28.50 |
| Ammonium nitrate (AN) | 38.00 |
| Al | 19.00 |
| $Fe_2O_3$ | 0.50 |
| DBTDA | 0.10 |
| Wt. % solids | 86 |
| Viscosity before DBTDA | 38 kP |
| Viscosity after DBTDA addition | 21 kP |
| Mix Bowl Temperature | ambient |

The PPO polymer, MO plasticizer, Al, and $F_2O_3$ were premixed for 5 minutes at ambient temperature. The solid oxidizers, AP and AN were batch added in several increments to achieve efficient wetting of the solid particles. This was accomplished by first adding about ½ of the AN to the mixture and mixing for 5 minutes. Approximately ⅔ of the AP was then added and mixed for 10 minutes. The remaining AN was added to the mixture and mixed for 5 minutes. The remaining AP was added and mixed for 5 minutes. Then the ISO cure agent was added and mixed for 10 minutes. The viscosity of this propellant mixture was measured to be 38 kP at ambient conditions. Finally, the DBTDA (dibutyltindiacetate) cure catalyst was added to the mixture and mixed for 10 minutes, the viscosity of the propellant mixture dramatically dropped to 21 kP. The propellant formulation was cast according to conventional techniques. The ambient cure of propellant 45833 was accomplished in 6 days.

EXAMPLE 4

A propellant composition numbered 45883 was prepared by combining the following ingredients.

| Propellant Mix 45883 | |
|---|---|
| Ingredient | Wt. % |
| Polypropylene oxide (PPO) | 10.02 |
| Mineral Oil (MO) | 2.00 |
| Isocyanate (ISO) | 0.96 |
| Ammonium perchlorate (AP) | 68.00 |
| Al | 19.00 |
| DBTDL | 0.02 |
| Wt. % solids | 87 |
| Viscosity before DBTDA | 42 kP |
| Viscosity after DBTDA addition | 10 kP |
| Mix Bowl Temperature | 114° F. |

The PPO polymer, MO plasticizer, and Al were premixed for 5 minutes at ambient temperature. The solid oxidizer, AP, was batch added in three increments to achieve efficient wetting of the solid particles. The ISO cure agent was then added and mixed for 10 minutes. The viscosity of this propellant mixture was measured to be 42 kP at a mix bowl temperature of about 114° F. Finally, the DBTDL (dibutyltindilaurate) cure catalyst was added to the mixture and mixed for 10 minutes, the viscosity of the propellant mixture dramatically dropped to 10 kP. The propellant formulation was cast according to conventional techniques.

EXAMPLE 5

A theoretical performance comparison was made between a PPO propellant composition at 85% solids loading, which represents the state-of-the-art (SOTA) and a higher solids (87%) PPO propellant composition achieved using the described invention. The SOTA composition at 85 wt % solids has a theoretical specific impulse of 258.5 $lb_f$-sec/$lb_m$ and a density of 0.06191 lbs/in$^3$. The use of the dialkyl tin catalyst as a wetting agent allows higher solids loading (87%) and higher performance to be achieved while maintaining low viscosities (<20 kp). The theoretical specific impulse for propellant 9002-13669 is 259.26 $lb_f$-sec/$lb_m$ and the density is 0.06293 lbs/in$^3$.

| Ingredient | SOTA Wt. % | Wt. % Mix 9002-13669 |
|---|---|---|
| Polypropylene oxide (PPO) | 10.99 | 9.99 |
| Isocyanate (ISO) | 1.00 | 1.00 |
| DOA | 3.00 | 2.00 |
| Al | 19.00 | 19.00 |
| AP | 37.00 | 38.5 |
| AN | 29.00 | 29.5 |
| DBTDA | 0.01 | 0.01 |
| Wt. % solids | 85.00 | 87.00 |
| ISP | 258.50 | 259.30 |
| Density (lbs/in$^3$) | 0.06191 | 0.06293 |

From the forgoing it will be appreciated that low levels (≦0.1 weight %) of a liquid dialkyl tin catalyst are used according to the present invention to process and cure composite propellants having high solids content at ambient temperatures.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A process for preparing a cast and cured high-solids propellant comprising:

casting an uncured high-solids composite propellant formulated from constituents comprising an ammonium nitrate oxidizing agent, a reactive metal, and a binder comprised of a branched polyether containing reactive, sterically hindered hydroxyl groups, a sterically hindered diisocyanate curing agent, a liquid dialkyl tin catalyst in the range from 0.002 to 0.1 weight percent of the propellant, wherein the weight percent of solids in the uncured high-solids composite propellant is greater than 85%; and curing the high-solids composite propellant.

2. A method according to claim 1, wherein the reactive metal is aluminum, magnesium, zinc, boron, tungsten, zirconium, titanium or a mixture of any thereof.

3. A method according to claim 1, wherein the branched polyether comprises polypropylene oxide, polybutylene oxide or a mixture thereof.

4. A method according to claim 3, wherein said binder comprises said branched polyether and ethylene oxide-copolymer, said ethylene oxide-copolymer being present in an amount up to 15%.

5. A method according to claim 1, wherein said liquid dialkyl tin catalyst ranges in size from a $C_2$ diacetate to a $C_{12}$ dilaurate.

6. A method according to claim 1, wherein said liquid dialkyl tin catalyst is dibutyl tin diacetate (DBTA).

7. A method according to claim 1, wherein said liquid dialkyl tin catalyst is dibutyl tin dilaurate (DBTDL).

8. A method according to claim 1, wherein said sterically hindered diisocyanate curing agent comprises isophorone diisocyanate (IPDI).

9. A method according to claim 1, wherein said sterically hindered diisocyanate curing agent comprises tetramethylxylenediisocyanate (TMXDI).

10. A method according to claim 1, wherein said uncured high-solids composite propellant further comprises a plasticizer.

11. A method according to claim 1, wherein said casting and said curing are conducted at temperature below the phased transition temperature of ammonium nitrate.

12. A method according to claim 1, wherein said casting and said curing are conducted at an ambient temperature up to about 100° F.

13. A method according to claim 1, wherein said curing occurs at a temperature in the range of about 20° C. to about 30° C.

14. A process for preparing a rocket motor containing a cast and cured high-solids propellant comprising:

providing a rocket motor case;

casting an uncured high-solids composite propellant in said case, said propellant being formulated from constituents comprising an ammonium nitrate oxidizing agent, a reactive metal, and a binder comprised of a branched polyether containing reactive, sterically hindered hydroxyl groups, a sterically hindered diisocyanate curing agent, a liquid dialkyl tin catalyst in the range from 0.002 to 0.1 weight percent of the propellant, wherein the weight percent of solids in the uncured high-solids composite propellant is greater than 85%; and curing the high-solids composite propellant.

* * * * *